United States Patent [19]

Daldry et al.

[11] Patent Number: 4,682,963

[45] Date of Patent: Jul. 28, 1987

[54] HIGH VOLTAGE PROCESSING OF CRT MOUNTS

[75] Inventors: Kenneth J. Daldry; Martin Fischman; Charles H. Rehkopf, all of Seneca Falls, N.Y.

[73] Assignee: North American Philips Consumer Electronics Corp., New York, N.Y.

[21] Appl. No.: 713,939

[22] Filed: Mar. 20, 1985

[51] Int. Cl.[4] ..... H01J 9/00

[52] U.S. Cl. ..... 445/5; 445/6

[58] Field of Search ..... 445/5, 6, 17, 18, 20

[56] References Cited

U.S. PATENT DOCUMENTS

| | | | |
|---|---|---|---|
| 1,376,604 | 5/1921 | Case | 445/18 |
| 1,760,454 | 5/1930 | Ulrey | 445/18 |
| 2,435,475 | 2/1948 | Stromeyer | 445/6 |
| 3,350,153 | 10/1967 | Einramhof | 445/6 |
| 3,736,038 | 5/1973 | Nakanishi | 445/5 |
| 4,052,776 | 10/1977 | Maskell | 445/5 |
| 4,214,798 | 7/1980 | Hopen | 445/5 |
| 4,395,242 | 7/1983 | Liller | 445/5 |
| 4,457,731 | 7/1984 | Patrickson | 445/5 |

FOREIGN PATENT DOCUMENTS

| | | | |
|---|---|---|---|
| 1045305 | 9/1983 | U.S.S.R. | 445/5 |

*Primary Examiner*—Kurt Rowan

*Attorney, Agent, or Firm*—John C. Fox

[57] ABSTRACT

CRT mounts for color television are effectively high voltage conditioned by impressing a high voltage DC potential on the mount anode, while at the same time impressing a high frequency pulsed AC potential on the final grid electrode, and allowing the focusing electrode to float electrically, thereby inducing arcing in the upper and lower gaps adjacent the focusing electrode. Preferably, this general conditioning is followed by a second conditioning step in which the focusing electrode is connected to the AC potential, to concentrate the arcing in the upper gap.

9 Claims, 5 Drawing Figures

HIGH VOLTAGE PROCESSING OF CRT MOUNTS

BACKGROUND OF THE INVENTION

This invention relates to the manufacture of cathode ray tubes (CRTs), and more particularly relates to the high voltage processing of CRT mounts.

In the manufacture of CRTs for color television, it is necessary to process the electron gun assembly (also called the "mount") after it has been sealed into the neck of the CRT, in order to minimize the occurrence of internal arcs during later CRT operation. Modern color CRTs are particularly susceptible to such internal arcing due to their relatively high operating voltages (e.g., 25 KV and higher), and complex electron gun structures having relatively small interelectrode spacings (e.g., mils). In high voltage processing (also called conditioning or spot knocking) internal arcing between electrodes is purposely induced to remove microscopic sources of field emission such as foreign particles and interelectrode projections, which could otherwise lead to detrimental arcing during later tube operation. To be effective, such conditioning should induce arcing not only in the upper gap (gap between the final focusing electrode and final accelerating electrode), but also in the lower gap (gap between the focusing electrode and the final grid electrode).

In U.S. Pat. No. 3,736,038, arcing in the upper gap is achieved by grounding the electrodes and impressing a high voltage above the operating voltage across the accelerating electrode (4) and ground. In addition, a resistor is placed between the focusing electrode (6) and ground, thereby causing arcing in the lower gap as well.

In U.S. Pat. No. 4,214,798, arcing in the lower gap is achieved by allowing the focusing electrode ($G_3$) to "float", that is, be unconnected, and by impressing a low frequency pulsed voltage across the final accelerating electrode (anode) and the other interconnected electrodes. Optionally, a second high frequency pulsed voltage is also impressed across these electrodes, said to increase the effectiveness of the spot knocking procedure.

Floating the $G_3$ electrode is said to have the advantages of eliminating the need for separate low voltage supplies as well as the need for providing socket leads for the focusing electrode. The use of pulsed conditioning voltages is said to have the advantage of enabling higher voltages without suffering adverse effects such as neck crazing and electrode metal sputtering.

The low frequency pulsed voltage is applied to the anode via the anode button, a metal contact extending through the CRT glass funnel sidewall. The anode and anode button are interconnected by an internal conductive coating on the funnel sidewall and upper portion of the neck, as well as by metal snubbers extending from the anode to the internal coating.

Because the low frequency pulsed voltage is a half wave rectified AC voltage with the positive portion clamped to ground, the anode voltage is negative, and the internal coating and snubbers are also negative with respect to the adjacent floating focusing electrode. This condition (negative voltage) has been found to enable field emissions from the snubbers and coating to occur, which can result in undesirable crazing or even cracking of the neck glass.

In addition, when known high voltage conditioning methods are practiced, in particular on the new mini-neck color CRTs, arcing at undesired locations sometimes occurs both externally between base pins, and internally between cathodes and heaters.

Accordingly, one object of the invention is to effectively high voltage condition the upper and lower gaps of an electron gun mount without inducing undesirable neck crazing and electrode sputtering.

Another object of the invention is to effectively high voltage condition mounts without inducing arcing at undesired locations in these mounts.

A further object of the invention is to high voltage condition CRT mounts in a manner to minimize or substantially eliminate external arcing between the base pins.

SUMMARY OF THE INVENTION

In accordance with the invention, CRT electron gun mounts are high voltage conditioned by electrically floating the focusing electrode, and impressing a positive high voltage DC potential on the anode via the anode button of the CRT, while simultaneously impressing a high frequency pulsed AC voltage on the final grid electrode adjacent the focusing electrode. The remaining mount elements are either connected to the AC source, or allowed to float electrically, depending upon the application and the design of the particular gun mount being processed.

Such conditioning, by avoiding the use of a negative voltage on the anode, thereby avoids the accompanying inducement of a negative charge on the snubbers and internal conductive coating in the vicinity of the focusing electrode, and significantly lessens the possibility of cracking or crazing of the neck glass in this vicinity. In addition, it has been found that the use of a DC voltage on the anode in conjunction with a pulsed high frequency AC voltage on the grid enables more effective conditioning of the lower gap, without promoting the neck crazing and electrode sputtering encountered previously with the use of high DC conditioning voltages.

The DC potential is chosen to be substantially higher than the CRT operating voltage, typically within the range of 40 to 50 kilovolts for an operating voltage of 25 to 28 kilovolts. The AC pulsed voltage should have a pulse frequency high enough to induce sufficient arcing for adequate conditioning, but not so high as to induce significant neck crazing or electrode sputtering. For this purpose, it has been found that the pulse frequency may range from about 0.5 to 10 kilohertz, with the peak potential of the pulses typically about the same as the CRT operating potential. By choosing an AC source having pulses of fast rise time (defined as the time for the pulse to go from 10 to 90 percent of its peak value) and short duration, for example, 0.3 microseconds and less than 10 microseconds, respectively, the tendency of arcing to occur externally between the base pins is significantly reduced.

The method is applicable to electron gun mounts having one focusing electrode, such as the high bipotential (HiBi), and the low bipotential (LoBi), as well as to mounts having two or more focusing electrodes, such as the low uni-bipotential (LoUniBi, also known as the quadripotential focus or QPF), the high unibipotential (HiUniBi, also known as the BiUni), and the tripotential focus (TPF). In each case, a focusing electrode is located adjacent to and rearward of the anode, the anode is connected to the DC source, the focusing electrode(s) float, and one or more electrodes adjacent to and rearward of the focusing electrode(s) are subjected to the pulsed AC potential, while the remaining mount elements are either connected to the AC potential or allowed to float, depending upon the particular application and mount design being processed.

The above-described high voltage conditioning process is advantageous in that it results in effective conditioning of both the upper and lower gaps of the electron gun mounts. However, for the most demanding applications, it has been found preferable to further condition the upper gap in a separate step following general conditioning. In this embodiment, general conditioning is carried out as described herein, and is then followed by a second conditioning step in which arcing is concentrated in the upper gap. This is accomplished by following the procedure of the general conditioning, except that the focusing electrodes are now connected to the AC source. Thus, as will be appreciated, the induced arcs will be primarily concentrated in the upper gap. The remaining elements may either be connected to the AC source, or floated, as desired.

BRIEF DESCRIPTION OF THE DRAWINGS

FIG. 2 depicts the set-up for general conditioning of a HiBi mount in a CRT having a narrow neck;

FIG. 3 depicts the set-up for conditioning the upper gap of the mount of FIG. 2;

FIG. 4 depicts the set-up for general conditioning of a HiUniBi mount in a CRT having a mini-neck.

DESCRIPTION OF THE PREFERRED EMBODIMENTS

Figure 1:
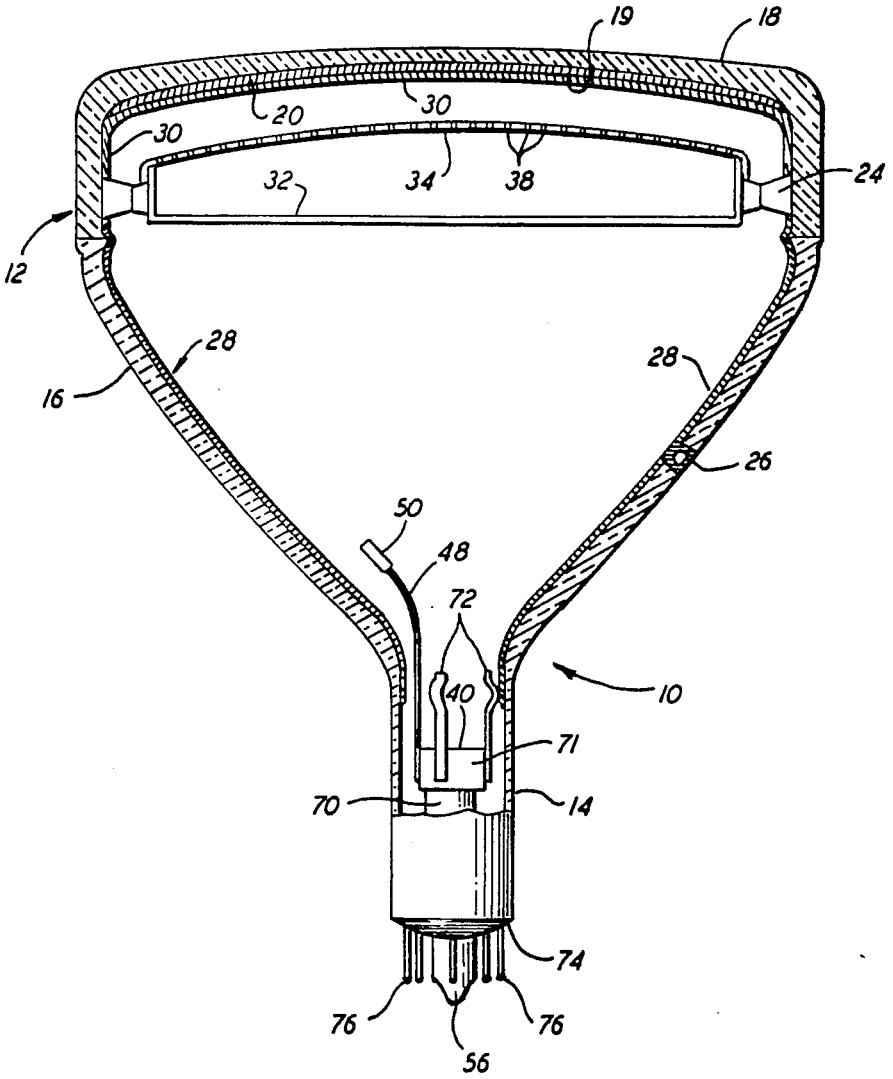
FIG. 1 is a top view, partly in section, of a typical color CRT containing an electron gun mount of the type to be conditioned by the method of the invention.

Referring now to FIG. 1, color CRT 10 is comprised of a glass envelope having integrated panel 12, neck 14 and funnel 16 portions. The face plate 18 of panel 12 has disposed on its inner surface 19 phosphor screen 20. The screen is composed of individual phosphor elements which during CRT operation are excited by scanning beams of electrons emanating from electron gun mount 40. There are three beams, one for each of the primary colors red, blue and green. These beams are directed to the desired phosphor elements on the screen by the aperture mask 34, containing apertures 38 and supported adjacent the screen by frame 32, which is in turn supported by studs 24 embedded in the panel.

Mount 40 is composed of a series of elements, only some of which are shown in FIG. 1. Accelerating electrode 70, the final electrode of the gun, is maintained at the operating potential of the CRT, typically 25 to 28 kilovolts, by electrical connection with anode button 26 through convergence cup 71, snubbers 72 and internal conductive coating 28. For convenience, the accelerating electrode is sometimes referred to herein as the anode.

The mask and screen are also maintained at operating potential, by means of contact of the metal mask-frame assembly with internal coating 28 and vaporized aluminum layer 30 covering the screen.

The electron beams are formed from streams of electrons emanating from thermionic cathodes, by maintaining each of the various remaining elements of the electron gun mount at critically determined voltages lower than the operating voltage at which the anode, mask and screen are maintained. Access to these elements is via connector pins 76 extending through the base 74 of the neck.

Figure 2:
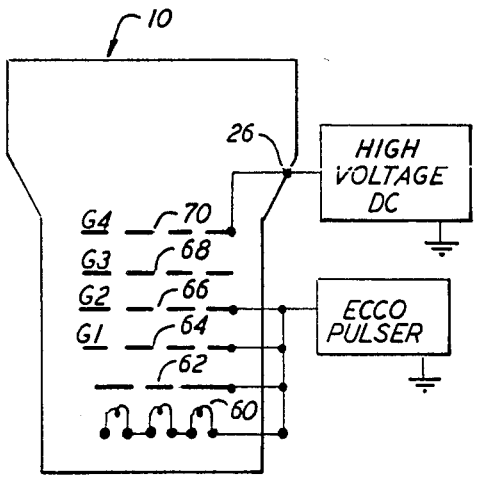
FIGS. 2 through 4 are schematic diagrams depicting the manner in which the various elements of the mounts are connected for conditioning as follows.

FIG. 2 depicts schematically typical HiBi mount elements in a CRT, connected as provided by the invention for high voltage processing. The various elements of the mount include cathode heaters 60, thermionic cathodes 62, first grid electrode 64 (often referred to as G1), final grid electrode 66 (G2), focusing electrode 68 (G3), and accelerating electrode 70 (G4 or anode). As may be appreciated, the relatively large potential differences between the anode and the other elements, as well as the relatively small distances between these elements, creates the likelihood for the occurrence of damaging internal arcing during tube operation. Thus, in order to reduce or eliminate potential sources of stray field emissions, the CRT mount is subjected to high voltage conditioning after assembly of the CRT is completed by: sealing the mount into the neck; exhausting and sealing the envelope through tubulation 56; and flashing of the getter 50, by external RF heating means, not shown.

In the arrangement of FIG. 2, typical for a HiBi mount of the type commonly employed in CRTs having a neck diameter of 29 millimeters (so-called narrow neck), the anode is connected to a positive high voltage DC potential (about 40 to 50 kilovolts), G3 is allowed to float electrically, that is, be unconnected, and the remaining elements, including the G2 and G1 grids, the cathode and the heaters, are all connected to a high frequency pulsed AC source. This source provides AC pulses occurring at a frequency of about 0.5 to 10 kilohertz, preferably about 1 to 2 kilohertz (one pulse per 0.5 to 1 millisecond), with each pulse being composed of about 3 to 10 cycles of a damped AC signal having a frequency of about one-half to ten megahertz, preferably about 1 to 2 megahertz (pulse duration of about 3 to 6 microseconds). The peak cycle in each pulse has a potential below that of the DC potential by an amount sufficient to induce sufficient arcing for conditioning, typically from about 25 to 28 kilovolts, and the rise time for this pulse is typically less than 1 microsecond, typically about 0.3 microseconds.

Figure 3:
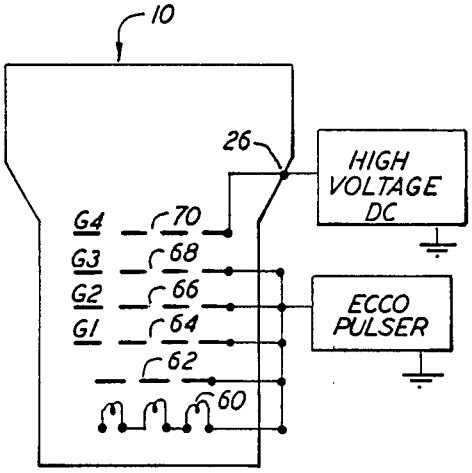

In FIG. 3, the HiBi mount of FIG. 2 is given a second conditioning, which concentrates the induced arcs in the upper gap (between G3 and G4), by connecting the G3 to the Ecco Pulser, along with the G2, G1, cathodes and heaters. Such conditioning is preferred for the most demanding applications in which little or no internal arcing can be tolerated during CRT operation.

Figure 4:
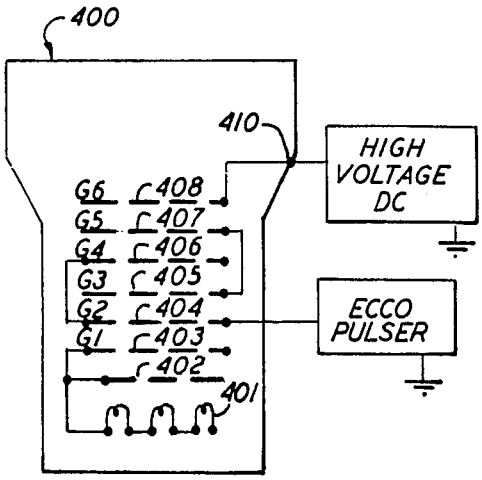

FIG. 4 shows a schematic for a HiUniBi mount of the type commonly used in CRTs having a neck diameter of 22.5 millimeters, (so-called mini-neck). In addition to the cathodes 402 and heaters 401, such a mount has six electrodes, designated 403 through 408 (G1 through G6, respectively). In this mount, the G2 grid and G4 are prefocusing electrodes which are interconnected and are thus maintained at a common potential during CRT operation, while G3 and G5 are focusing electrodes which are also interconnected and at a common (higher) potential during operation.

Apparently because of the smaller size and greater complexity of the mini-neck mount, resulting in smaller spacings between mount elements and between the mount and the adjacent neck wall, it has been found that more effective conditioning can be obtained by connecting the Ecco Pulser to the G2 and G4 electrodes, and allowing the lower elements (G1 electrode, cathodes and heaters to float (separately or connected together), as well as the G3 and G5 focusing electrodes. In particular, allowing the lower elements to float avoids the possibility of damaging arcs occurring between the cathodes and heaters. Of course, such floating of the lower elements need not be limited to this situation, but could also be applied to mini-neck CRTs having other mount types, as well as to CRTs having other neck sizes, such as narrow neck. It is essential, however, that the final grid electrode, that is, the electrode adjacent to and rearward of a focusing electrode, and any prefocusing electrode adjacent a focusing electrode, be connected to the AC source in order to induce arcing in the lower gap or gaps between the focusing electrode(s) and these adjacent electrodes.

Figure 5:
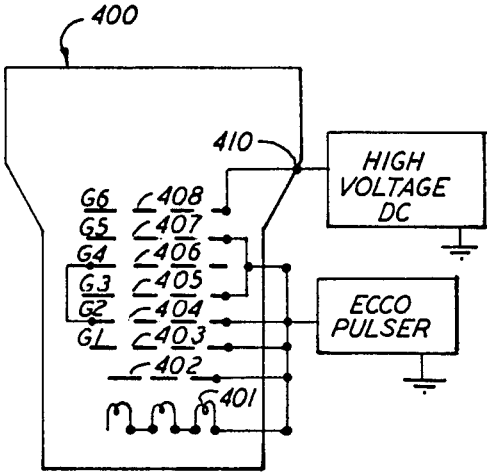
FIG. 5 depicts the set-up for conditioning of the upper gap of the mount of FIG. 4.

FIG. 5 shows the arrangement for conditioning the upper gap of the mount of FIG. 4, carried out as a separate second step following general conditioning. As in the case of the HiBi mount of FIGS. 2 and 3, the focusing electrode (in this case the G5) is connected to the Ecco Pulser, thereby confining the induced arcs largely to the gap between G5 and G6, and in general achieving a more effective conditioning of this gap than could otherwise be obtained through general conditioning alone.

Other mount types may be conditioned using the principles set forth herein, that is, arcing between the gaps adjacent the focusing electrode(s), (the upper and lower gaps) is induced by impressing a high voltage DC potential on the electrode of the mount adjacent to and forward of the focusing electrode (usually the last electrode of the mount and referred to as the anode or accelerating electrode), while at the same time impressing a high frequency pulsed AC potential, having a lower voltage than the DC potential, on at least the electrode adjacent to and rearward of the focusing electrode (usually the second grid or prefocusing electrode). Such conditioning results in a large number of induced arcs of short duration, sufficient to substantially eliminate undesirable sources of field emission, without accompanying deleterious side effects, such as external arcing between connector pins, neck crazing and electrode sputtering.

While there have been shown and described what are at present considered to be the preferred embodiments of the invention, it will be obvious to those skilled in the art that various changes and modifications may be made therein without departing from the scope of the invention as defined by the appended claims.

What is claimed is:

1. A method for high voltage conditioning the mount of a cathode ray tube, the mount comprising a plurality of elements including at least one thermionic cathode and associated heater for emitting a stream of electrons, and a series of electrodes for forming and focusing such electrons into a beam, the electrodes including an anode, at least one focusing electrode adjacent to and rearward of the anode, and at least one electrode rearward of and adjacent to the focusing electrode, the method comprising:

impressing a positive high voltage DC potential on the anode, while at the same time impressing a high frequency pulsed AC potential on at least the electrode rearward of the focusing electrode, and allowing the focusing electrode to float electrically, the voltage of the AC potential being less than that of the DC potential by an amount sufficient to induce arcing in the gaps between the anode and the focusing electrode, and between the focusing electrode and the adjacent rearward electrode.

2. The method of claim 1 in which all of the mount elements rearward of the focusing electrode are connected to the AC potential.

3. The method of claim 1 in which the electrode rearward of and adjacent to the focusing electrode is the final grid electrode and all of the mount elements rearward of the final grid electrode are allowed to float electrically.

4. The method of claim 1 in which the AC pulses occur at a frequency of about 0.5 to 10 kilohertz.

5. The method of claim 4 in which each AC pulse comprises from about 3 to 10 cycles of a damped AC signal having a frequency of about 0.5 to 10 megahertz.

6. The method of claim 1 in which the peak voltage of the AC pulses is about the same as the operating voltage of the CRT.

7. The method of claim 1 in which following such high voltage conditioning, the mount is subjected to a second conditioning in which a positive high voltage DC potential is impressed on the anode, while at the same time a high frequency pulsed AC potential is impressed on the focusing electrode, the voltage of the AC potential being less than that of the DC potential by an amount sufficient to induce arcing in the gap between the anode and the focusing electrode.

8. The method of claim 1 in which there are two focusing electrodes, a first focusing electrode adjacent to and rearward of the anode and a second focusing electrode rearward of the first focusing electrode, and in which there are two prefocusing electrodes, a first prefocusing electrode between the focusing electrodes and a final grid electrode as a second prefocusing electrode adjacent to and rearward of the second focusing electrode, the focusing electrode being electrically interconnected, and the prefocusing electrodes being interconnected, and in which the prefocusing electrodes are connected to the AC source and the remaining elements are allowed to float electrically.

9. The method of claim 8 in which following such high voltage conditioning, the mount is subjected to a second conditioning in which a positive high voltage DC potential is impressed on the anode, while at the same time a high frequency pulsed AC potential is impressed on the focusing and prefocusing electrodes, the voltage of the AC potential being less than that of the DC potential by an amount sufficient to induce arcing in the gaps between the anode and the first focusing electrode, the first focusing electrode and the first prefocusing electrode, the first prefocusing electrode and the second focusing electrode, and the second focusing electrode and the second prefocusing electrode.

* * * * *